US005755828A

United States Patent [19]

Westland

[11] Patent Number: 5,755,828

[45] Date of Patent: May 26, 1998

[54] METHOD AND COMPOSITION FOR INCREASING THE STRENGTH OF COMPOSITIONS CONTAINING HIGH-BULK FIBERS

[75] Inventor: John A. Westland, Auburn, Wash.

[73] Assignee: Weyerhaeuser Company, Federal Way, Wash.

[21] Appl. No.: 768,616

[22] Filed: Dec. 18, 1996

[51] Int. Cl.[6] ..... D06M 13/192; D06M 13/35

[52] U.S. Cl. ..... 8/185; 8/116.1; 8/181; 8/182; 8/183; 8/184; 8/186; 8/190; 8/120; 162/72; 162/76; 162/9; 162/157.2; 162/157.3; 162/157.6; 162/158; 162/146; 428/361; 428/365; 428/368; 442/104; 442/105; 442/107

[58] Field of Search ..... 8/116.1, 181, 182, 8/183, 184, 185, 186, 190, 120; 162/72, 76, 157.2, 157.3, 157.6, 158, 146, 9; 428/361, 365, 368; 442/104, 105, 107

[56] References Cited

U.S. PATENT DOCUMENTS

| | | | |
|---|---|---|---|
| 3,731,411 | 5/1973 | Barber et al. . | |
| 3,854,866 | 12/1974 | Franklin et al. | 8/185 |
| 5,137,537 | 8/1992 | Herron et al. . | |
| 5,183,707 | 2/1993 | Herron et al. . | |
| 5,190,563 | 3/1993 | Herron et al. . | |
| 5,427,587 | 6/1995 | Arkens et al. . | |
| 5,447,977 | 9/1995 | Hansen et al. . | |
| 5,496,476 | 3/1996 | Tang et al. | 8/120 |
| 5,496,477 | 3/1996 | Tang et al. . | |
| 5,549,791 | 8/1996 | Herron et al. . | |

*Primary Examiner*—Alan Diamond

*Attorney, Agent, or Firm*—Christensen O'Connor Johnson & Kindness PLLC

[57] ABSTRACT

Crosslinked cellulose fibers having free pendant carboxylic acid groups are disclosed. The fibers include a polycarboxylic acid covalently coupled to the fibers, and are crosslinked with a crosslinking agent having a cure temperature lower than the cure temperature of the polycarboxylic acid. Methods for producing the fibers and for producing a fibrous sheet incorporating the fibers are also disclosed.

25 Claims, No Drawings

METHOD AND COMPOSITION FOR INCREASING THE STRENGTH OF COMPOSITIONS CONTAINING HIGH-BULK FIBERS

FIELD OF THE INVENTION

The present invention is generally directed to a method and composition for increasing the strength of compositions containing high-bulk fibers. More specifically, the invention is directed to cellulose fibers modified to include free pendant carboxylic acid groups that impart increased strength to products prepared from these fibers.

BACKGROUND OF THE INVENTION

Cellulose products such as absorbent sheets and other structures are composed of cellulose fibers, which, in turn, are composed of individual cellulose chains. Commonly, cellulose fibers are crosslinked to impart advantageous properties such as increased absorbent capacity, bulk, and resilience to products containing such crosslinked fibers. High-bulk fibers are generally highly crosslinked fibers and are characterized by high absorbent capacity and resilience.

Crosslinked cellulose fibers and methods for their preparation are widely known. Tersoro and Willard, *Cellulose and Cellulose Derivatives*, Bikales and Segal, eds., Part V, Wiley-Interscience, New York, (1971), pp. 835–875. Crosslinked cellulose fibers are prepared by treating fibers with a crosslinking agent. Crosslinking agents are generally bifunctional compounds that, in the context of cellulose crosslinking, covalently couple a hydroxy group of one cellulose chain to another hydroxy group on a neighboring cellulose chain. In the crosslinking process, cellulose hydroxy groups are consumed and replaced with crosslinks (i.e., covalent bonds linking the crosslinking agent to the cellulose fiber). For example, the loss of hydroxy groups upon cellulose crosslinking with a carboxylic acid crosslinking agent is accompanied by the formation of ester bonds.

The tensile or sheet strength of fibrous products derived from cellulose fibers is due in large part to attractive fiber-to-fiber interactions. These interfiber interactions include hydrogen bonding interactions between fibers having hydrogen bonding sites. For cellulose, hydrogen bonding sites primarily include the hydroxy groups of the individual cellulose chains.

In general, crosslinked fibers have greater absorbent capacity, bulk, and resilience than noncrosslinked or untreated cellulose fibers. Conversely, by virtue of the availability of their hydroxy groups as sites for hydrogen bonding, untreated cellulose fibers have greater bondability to other cellulose fibers. The result is that, although fibrous products derived from crosslinked fibers possess advantageous absorbent properties, these products typically suffer from undesirably low tensile or sheet strength. The relatively low tensile strength is primarily attributed to the reduction of interfiber hydrogen bonding resulting from the depletion of a fiber's hydrogen bonding sites (i.e., cellulose hydroxy groups) upon crosslinking. As noted above, crosslinking agents react at the fiber's hydrogen bonding sites, converting the sites to crosslinks that generally do not significantly participate in interfiber hydrogen bonding. Consequently, the advantageous absorbent properties associated with crosslinked fibers are accompanied by a corresponding reduction in the fibers' bondability to other fibers.

Accordingly, there is a need in the art for high-bulk cellulose fibers having advantageous absorbent properties and, in addition, having enhanced bondability so as to increase the strength of products that incorporate these fibers. The present invention fulfills these needs and offers further related advantages.

SUMMARY OF THE INVENTION

In one aspect, the present invention provides cellulose fibers crosslinked with a crosslinking agent, and a polycarboxylic acid covalently coupled to the fibers through an ester bond. Preferably, the crosslinking agent has a cure temperature lower than the cure temperature of the polycarboxylic acid. In a preferred embodiment, the polycarboxylic acid is polyacrylic acid.

Fiber sheets containing cellulose fibers having free pendant carboxylic acid groups and absorbent products containing these fiber sheets are also disclosed.

In another aspect of the invention, a method for producing cellulose fibers having enhanced bondability is provided. The method produces cellulose fibers having free pendant carboxylic acid groups. In the method, a crosslinking agent and a polycarboxylic acid are applied to the fibers, and then cured at a temperature sufficient to effect crosslink formation between the crosslinking agent and the fibers, and ester bond formation between the polycarboxylic acid and the fiber. Preferably, ester bond formation between the polycarboxylic acid and the fiber is the formation of a single ester bond, and not the formation of extensive ester crosslinks.

Fiber sheets containing crosslinked cellulose fibers having free pendant carboxylic acid groups and absorbent products containing these fiber sheets are also disclosed.

In a further embodiment of this aspect of the invention, a method for producing a high-bulk cellulose fiber sheet having increased tensile strength is provided. In the method, untreated fibers are combined with cellulose fibers having free pendant carboxylic acid groups and formed into a fibrous sheet.

DETAILED DESCRIPTION OF THE PREFERRED EMBODIMENT

The present invention is directed to cellulose fibers having enhanced bondability and methods related to such fibers. More specifically, the invention relates to cellulose fibers having free pendant carboxylic acid groups, products containing these cellulose fibers, and methods related to producing and using these fibers. The cellulose fibers of the invention exhibit high absorbent capacity, bulk, and resilience, and when such fibers are substituted for conventionally crosslinked fibers in a crosslinked fiber/untreated fiber mixture, the resulting sheet has increased tensile or sheet strength.

In one aspect, the present invention provides cellulose fibers having enhanced bondability. These fibers include a polycarboxylic acid covalently coupled to the cellulose fibers. By virtue of the polycarboxylic acid covalently coupled to the fibers, the cellulose fibers of the invention have free pendant carboxylic acid groups.

As used herein the term "free pendant carboxylic acid group" refers to a carboxylic acid substituent of a polycarboxylic acid present after partially curing the polycarboxylic acid (i.e., after ester bond formation between a carboxylic acid group of the polycarboxylic acid and a hydroxy group of the cellulose fiber). Such a carboxylic acid group is pendant from the polycarboxylic acid and free to form hydrogen bonds with, for example, other fibers. The fibers of the present invention are produced by "partially curing" a polycarboxylic acid in the presence of the fibers. While "curing" refers to the exhaustive reaction of an agent (e.g., a crosslinking agent) with the fibers, partial curing refers to less than exhaustive reaction. For example, for many crosslinking agents, including polycarboxylic acid crosslinking agents, exhaustive reaction between substantially all the agent's carboxylic acid groups and the fibers is desired and accomplished by either prolonged reaction times and/or elevated cure temperatures. Partial curing refers to nonexhaustive reaction, for example, the coupling of less than all, and preferably only a single carboxylic acid group of a polycarboxylic acid to a fiber. While exhaustive reaction occurs at a compound's cure temperature, less than exhaustive reaction or only partial curing occurs at less than the compound's cure temperature. The extent of curing is also a function of the period of time that a curable agent is heated at a given cure temperature.

Those knowledgeable in the area of polycarboxylic acids will recognize that the polycarboxylic acids useful in the present invention may be present on the fibers in a variety of forms including, for example, the free acid form, and salts thereof. Although the free acid form is preferred, it will be appreciated that all such forms are included within the scope of the invention.

In the context of the present invention, suitable polycarboxylic acids include polycarboxylic acids having molecular weights of at least about 500 grams/mole, preferably within the molecular weight range from about 500 to about 25,000 grams/mole, more preferably from about 1,000 to about 10,000 grams/mole, and most preferably from about 1,500 to about 5,000 grams/mole.

The polycarboxylic acid can be a polymeric polycarboxylic acid. Suitable polymeric polycarboxylic acids include homopolymeric and copolymeric polycarboxylic acids. Representative homopolymeric polycarboxylic acids include, for example, polyacrylic acid, polyaspartic acid, polyglutamic acid, poly(3-hydroxybutyric acid) and polymaleic acid. Examples of representative copolymeric polycarboxylic acids include polyacrylic acid copolymers such as poly(acrylamide-co-acrylic acid), poly(acrylic acid-co-maleic acid), poly(ethylene-co-acrylic acid), and poly(1-vinylpyrrolidone-co-acrylic acid), as well as other polycarboxylic acid copolymers including poly(ethylene-co-methacrylic acid), poly(methyl methacrylate-co-methacrylic acid), poly(methyl vinyl ether-co-maleic acid), poly (styrene-co-maleic acid), poly(3-hydroxybutyric acid-co-3-hydroxyvaleric acid), and poly(vinyl chloride-co-vinyl acetate-co-maleic acid). In one preferred embodiment, the polymeric polycarboxylic acid is polyacrylic acid. In another preferred embodiment, the polymeric polycarboxylic acid is a copolymer of acrylic acid, and preferably a copolymer of acrylic acid and another acid, for example, maleic acid. The representative polycarboxylic acids noted above are available in various molecular weights and ranges of molecular weights from commercial sources.

The polycarboxylic acids noted above can be used alone or in combination with others to provide the cellulose fibers of the present invention having free pendant carboxylic acid groups.

To more readily appreciate the chemical and structural properties of the polycarboxylic acid useful in this invention, and more particularly the relationship between the molecular weight, length, and number of carboxylic acid groups of the polycarboxylic acid, consideration of a representative polycarboxylic acid, polyacrylic acid, is illustrative. As noted above, the polycarboxylic acid coupled to the fibers of the invention includes polyacrylic acids having molecular weights of at least about 500 grams/mole, preferably within the molecular weight range from about 1000 to about 15,000 grams/mole, and more preferably from about 1500 to about 5000 grams/mole. Accordingly, the polycarboxylic acid includes polyacrylic acids having greater than about 7 acrylic acid residues (acrylic acid repeating units in the polymer), preferably from about 10 to about 200 acrylic acid residues, and more preferably from about 20 to about 70 acrylic acid residues. Consequently, the polycarboxylic acid includes polyacrylic acids having greater than about 7 carboxylic acid groups, preferably from about 10 to about 200 carboxylic acid groups, and more preferably from about 20 to about 70 carboxylic acid groups. The polycarboxylic acid is polyfunctional and has the capacity to provide a relatively large number of carboxylic acid groups useful in interfiber hydrogen bonding and enhancing the strength of fibrous sheets, webs, and mats that incorporate such fibers.

The cellulose fibers having free pendant carboxylic acid groups formed in accordance with the present invention include a polycarboxylic acid preferably having a molecular weight of at least about 500 grams/mole covalently coupled to a cellulose fiber through an ester bond. Although the polycarboxylic acid useful in the present invention is not a crosslinking agent, it will be appreciated that the formation of multiple ester bonds between a polycarboxylic acid and one or more cellulose chains or fibers can occur and, therefore, such bonding between the polycarboxylic acid and the fibers is within the scope of this invention. For example, the polycarboxylic acid may form a single ester bond to a cellulose chain, two or more ester bonds with a chain, or two or more ester bonds between two or more chains or fibers. In any event, after covalent coupling to the fiber, the polycarboxylic acid has at least five free pendant carboxylic acid groups.

Polymeric polyacrylic acid crosslinking agents for cellulosic fibers have been described. See, for example, U.S. Pat. No. 5,549,791, issued to Herron et al. These polyacrylic acid crosslinking agents were found to be particularly suitable for forming ester crosslink bonds with cellulosic fibers. Unlike conventional crosslinking agents that are temperature sensitive, polyacrylic acid is stable at high temperatures and, therefore, these crosslinking agents can be subjected to elevated cure temperatures to effectively and efficiently provide highly crosslinked fibers. Generally, these polyacrylic acid crosslinking agents penetrate into the interior of the individual fibers and are then cured by subjecting the crosslinking agent treated fibers to elevated temperatures (e.g., an acrylic/maleic copolymer cured at about 370° F. for about 8 minutes, and polyacrylic acid polymer cured at about 375° F. for about 30 minutes). The result is the formation of intrafiber crosslink bonds. As noted in the Herron patent, fibers thus crosslinked provide increased resilience and absorbent capacity to absorbent structures containing these fibers.

In contrast to the polyacrylic acid crosslinking agent treatment described in Herron, in the present invention the polycarboxylic acids are not subjected to elevated cure temperatures to effect exhaustive polycarboxylic acid to fiber crosslinking. Rather, in this invention, the polycarboxylic acid is cured at a significantly lower temperature to accomplish the opposite effect, namely, to effect covalent coupling of the carboxylic acid to the fibers and at the same time, maintain sufficient free carboxylic acid groups (i.e., not crosslinked) to impart the advantageous properties of bondability to the fibers and strength to fibrous compositions incorporating these fibers. In the context of the present invention, the polycarboxylic acid is optimally covalently coupled to the fiber through a single carboxylic acid group, forming a single ester bond between the fiber and the polycarboxylic acid. Reaction through a single carboxylic acid group allows the remaining carboxylic acid groups of the polycarboxylic acid to participate in interfiber interactions (e.g., hydrogen bonding) in fibrous compositions thereby enhancing the strength of those compositions. Thus, although the invention described in Herron and the present invention generally incorporate a polycarboxylic acid into cellulose fibers, because of the diverse treatments and goals, the resulting products are distinct. Herron utilizes polyacrylic acid as a crosslinking agent. The present invention utilizes a polycarboxylic acid as a strengthening agent to enhance the fibers' bondability. The effect of cure temperature on the strength of fiber sheets incorporating the fibers of the present invention is described in Example 2.

The cellulose fibers having free pendant carboxylic acid groups have an effective amount of a polycarboxylic acid covalently coupled to the fibers through an ester bond. That is, polycarboxylic acid sufficient to provide an improvement in strength (e.g., tensile, sheet) in compositions (e.g., fibrous sheets, webs, mats) containing the cellulose fibers to which the polycarboxylic acid is covalently coupled, relative to conventional fibers lacking such free pendant carboxylic acid groups. As described in Example 1, fiber sheets prepared from a combination of untreated fibers and fibers having free pendant carboxylic acid groups (i.e., DMDHEU crosslinked/polyacrylic acid) have increased tensile strength compared to fiber sheets prepared from untreated and crosslinked fibers having no pendant carboxylic acid groups (i.e., DMDHEU crosslinked) only. Generally, the cellulose fibers are treated with a sufficient amount of a polycarboxylic acid such that an effective amount of polycarboxylic acid is covalently coupled to the fibers.

The polycarboxylic acid is preferably present on the fibers in an amount from about 0.1 to about 10 percent by weight of the total weight of the fibers. More preferably, the polycarboxylic acid is present in an amount from about 1 to about 6 percent by weight of the total weight of the fibers, and in a particularly preferred embodiment, from about 2 to about 4 percent by weight of the total weight of the fibers. At less than about 0.1 percent by weight polycarboxylic acid, no significant bondability enhancement is observed, and at greater than about 10 percent by weight, the fibers begin to become disadvantageously brittle.

For the polycarboxylic acids having molecular weights from about 1000 to about 15,000 grams/mole, the preferred range of polycarboxylic acid on the fibers (i.e., from about 0.1 to about 10 percent by weight of the total fibers) corresponds to a range from about 0.001 to about 0.20 mole percent polycarboxylic acid (based on the molecular weight of 162 grams/mole for one anhydroglucose unit). Accordingly, in the context of the present invention, the amount of polycarboxylic acid on the fibers is significantly less than for previously disclosed low molecular weight polycarboxylic acid crosslinked fibers having an effective amount of crosslinking agent in the range from about 0.5 to about 10 mole percent (see, e.g., U.S. Pat. Nos. 5,137,537; 5,183,707 and 5,190,563).

The polycarboxylic acid may be applied to the fibers for covalent coupling by any one of a number of methods known in the production of treated fibers. For example, the polycarboxylic acid may be contacted with the fibers as a fiber sheet is passed through a bath containing the polycarboxylic acid. Alternatively, other methods of applying the polycarboxylic acid, including fiber spraying, or spraying and pressing, or dipping and pressing with a polycarboxylic acid solution, are also within the scope of the invention.

Preferably, the fibers of the present invention having free pendant carboxylic acid groups are cellulose fibers that have been crosslinked with a crosslinking agent. Preferable crosslinking agents have a cure temperature below that of the polycarboxylic acid, i.e., below about 320° F. The use of crosslinking agents having cure temperatures below the cure temperature of the polycarboxylic acid permits the full curing of the crosslinking agent, while only partially curing the polycarboxylic acid (as described above). Preferred crosslinking agents include urea derivatives, for example, methylolated urea, methylolated cyclic ureas, methylolated lower alkyl substituted cyclic ureas, dihydroxy cyclic ureas, lower alkyl substituted dihydroxy cyclic ureas, methylolated dihydroxy cyclic ureas. Other preferred crosslinking agents include dimethyldihydroxy urea (DMDHU, 1,3-dimethyl-4,5-dihydroxy-2-imidazolidinone), dimethyloldihydroxyethylene urea (DMDHEU, 1,3-dihydroxymethyl-4,5-dihydroxy-2-imidazolidinone), dimethylol urea (DMU, bis [N-hydroxymethyl]urea), dihydroxyethylene urea (DHEU, 4,5-dihydroxy-2-imidazolidinone), dimethylolethylene urea (DMEU, 1,3-dihydroxymethyl-2-imidazolidinone), dimethyldihydroxyethylene urea (DDI, 4,5-dihydroxy-1,3-dimethyl-2-imidazolidinone) and maleic anhydride. In a preferred embodiment, the crosslinking agent is dimethyloldihydroxyethylene urea (DMDHEU). Crosslinking catalysts can be used in combination with the crosslinking agent to promote crosslink formation.

Generally, the crosslinked cellulose fibers of the present invention having free pendant carboxylic acid groups can be prepared by applying a polycarboxylic acid, as described above, and a crosslinking agent having a cure temperature below the cure temperature of the polycarboxylic acid to cellulose fibers, and then curing the polycarboxylic acid and crosslinking agent at a temperature sufficient to effect crosslink formation between the crosslinking agent and the fibers, and ester bond formation between the polycarboxylic acid and the fibers. In the context of the present invention, such ester bond formation between the polycarboxylic acid and fibers is not exhaustive ester bond formation as in fiber crosslinking. The temperature sufficient to effect ester bond formation is lower than the cure temperature of the crosslinking agent and will vary depending upon the specific acid and moisture content of the fibers among other factors. For the exemplary acid, polyacrylic acid, the temperature sufficient to effect ester bond formation ranges from about 320° F. to about 380° F. The use of a catalyst, as described above, to promote crosslinking and ester bond formation between the polycarboxylic acid and the cellulose fiber in the method is optional and may reduce the temperature required to effect ester bond formation. While catalysts can be used to effectively lower the cure temperature of both the crosslinking agent and polycarboxylic acid, in accordance with the present invention, the use of catalysts preferably does not result in exhaustive crosslinking of the polycarboxylic acid to the fibers.

The cellulose fibers of the invention may also be prepared with the aid of a catalyst. In such a method, the catalyst is applied to the cellulose fibers in a manner analogous to application of the polycarboxylic acid to the fibers as described above. The catalyst may be applied to the fibers prior to, after, or at the same time that the polycarboxylic acid is applied to the fibers. Accordingly, the present invention provides a method of producing fibers having free pendant carboxylic acid groups that includes curing the crosslinking agent and the polycarboxylic acid in the presence or absence of a catalyst.

Generally, the catalyst promotes the formation of bonds between the crosslinking agent and/or polycarboxylic acid and the cellulose fibers. The catalyst is effective in increasing ester bond formation (i.e., the number of bonds formed) at a given cure temperature.

Suitable catalysts include any catalyst that increases the rate of bond formation between the crosslinking agent and/or polycarboxylic acid described above and cellulose fibers. Preferred catalysts include alkali metal salts of phosphorous containing acids such as alkali metal hypophosphites, alkali metal phosphites, alkali metal polyphosphonates, alkali metal phosphates, and alkali metal sulfonates. Particularly preferred catalysts include alkali metal polyphosphonates such as sodium hexametaphosphate, and alkali metal hypophosphites such as sodium hypophosphite. When a catalyst is used to promote bond formation, the catalyst is typically present in an amount in the range from about 5 to about 20 weight percent of the polycarboxylic acid. Preferably, the catalyst is present in an amount of about 10 percent by weight of the polycarboxylic acid.

In general, the cellulose fibers of the present invention may be prepared by a system and apparatus as described in U.S. Pat. No. 5,447,977 to Young, Sr. et al. which is incorporated herein by reference in its entirety. Briefly, the fibers are prepared by a system and apparatus comprising a conveying device for transporting a mat of cellulose fibers through a fiber treatment zone; an applicator for applying a treatment substance such as a crosslinking agent and a polycarboxylic acid from a source to the fibers at the fiber treatment zone; a fiberizer for completely separating the individual cellulose fibers comprising the mat to form a fiber output comprised of substantially unbroken cellulose fibers; and a dryer coupled to the fiberizer for flash evaporating residual moisture and for curing the crosslinking agent and the polycarboxylic acid, to form dried and cured fibers.

As used herein, the term "mat" refers to any nonwoven sheet structure comprising cellulose fibers or other fibers that are not covalently bound together. The fibers include fibers obtained from wood pulp or other sources including cotton rag, hemp, grasses, cane, husks, cornstalks, or other suitable sources of cellulose fibers that may be laid into a sheet. The mat of cellulose fibers is preferably in an extended sheet form, and may be one of a number of baled sheets of discrete size or may be a continuous roll.

Each mat of cellulose fibers is transported by a conveying device, for example, a conveyor belt or a series of driven rollers. The conveying device carries the mats through the fiber treatment zone.

At the fiber treatment zone the crosslinking agent and polycarboxylic acid are applied to the cellulose fibers. The crosslinking agent and polycarboxylic acid are preferably applied to one or both surfaces of the mat using any one of a variety of methods known in the art including spraying, rolling, or dipping. Once the materials have been applied to the mat, the materials may be uniformly distributed through the mat, for example, by passing the mat through a pair of rollers.

After the fibers have been treated with the crosslinking agent and polycarboxylic acid, the impregnated mat is fiberized by feeding the mat through a hammermill. The hammermill serves to separate the mat into its component individual cellulose fibers, which are then blown into a dryer.

The dryer performs two sequential functions; first removing residual moisture from the fibers, and second curing the crosslinking agent and polycarboxylic acid in accordance with the present invention. In one embodiment, the dryer comprises a first drying zone for receiving the fibers and for removing residual moisture from the fibers via a flash-drying method, and a second drying zone for curing. Alternatively, in another embodiment, the treated fibers are blown through a flash-dryer to remove residual moisture, and then transferred to an oven where the treated fibers are subsequently cured in accordance with the present invention.

Crosslinked cellulose fibers having free pendant carboxylic acid groups provide advantageous absorbent properties characteristic of crosslinked fibers including high capacity, bulk, and resilience relative to noncrosslinked fibers. Furthermore, because these fibers are crosslinked with a low cure temperature crosslinking agent, crosslinking is achieved at a temperature lower than the cure temperature of the polycarboxylic acid, thus minimizing any polycarboxylic acid crosslinking. Consequently, although hydrogen bonding sites are consumed by the crosslinking agent, by virtue of the partially cured high cure temperature polycarboxylic acid component, hydrogen bonding sites are added to the fiber in the crosslinking process. These hydrogen bonding sites include the free pendant carboxylic acid groups of the partially cured polycarboxylic acid. The crosslinked fibers of this embodiment, cured at a temperature below the cure temperature of the polycarboxylic acid (i.e., the temperature at which exhaustive crosslinking occurs), have an increased number of free pendant carboxylic acid groups relative to fibers cured with the crosslinking agent alone or at a higher cure temperature with the polycarboxylic acid alone.

The fibers of the invention having free pendant carboxylic acid groups may be formed into sheets or mats having high absorbent capacity, bulk, resilience, and increased tensile strength. For example, these fibers may be combined with other fibers such as crosslinked and noncrosslinked fibers, including high-bulk fibers. The sheets and mats comprised of fibers having free pendant carboxylic acid groups may be incorporated into a variety of absorbent products including, for example, tissue sheets, disposable diapers, adult incontinence products, sanitary napkins and feminine hygiene products such as tampons, bandages, and meat pad products.

It has been observed that crosslinked cellulose fibers having free pendant carboxylic acid groups of the present invention, when used to replace conventionally crosslinked cellulose fibers in a sheet or web of crosslinked fibers and uncrosslinked fibers, can increase the tensile strength of the sheet. As noted above, the fibers' free pendant carboxylic acid groups provide hydrogen bonding sites that enhance the fiber's bondability to other fibers.

In another aspect, the present invention provides a method for producing a high-bulk fiber sheet having increased tensile strength. In the method, untreated fibers are combined with the cellulose fibers of the present invention (e.g., crosslinked cellulose fibers having free pendant carboxylic acid groups), and then formed into a sheet or mat. In a preferred embodiment, the cellulose fibers having free pendant carboxylic acid groups have from about 1 to about 4 percent by weight polycarboxylic acid on the fibers, with the polycarboxylic acid having been partially cured at a temperature from about 300° F. to about 340° F. The cellulose fibers having free pendant carboxylic acid groups are present in an amount from about 20 to about 100, and preferably from about 30 to about 60 percent by weight of the total fibers combined to form the sheet. The high-bulk sheet produced by the method has increased tensile strength relative to a sheet similarly prepared from high-bulk fibers that lack free pendant carboxylic acid groups.

The preparation and properties of a fiber sheet formed from crosslinked fibers having free pendant carboxylic acid groups using a representative crosslinking agent (i.e., dimethyloldihydroxyethylene urea) and polycarboxylic acid (i.e., polyacrylic acid) are described in Examples 1 and 2. As shown in the examples, incorporation of such a crosslinked fiber into a fiber sheet, increases the sheet's tensile index. In Example 1, sheets were prepared from a blend of crosslinked fiber and untreated fibers (2:1) (see, e.g., Example 1, Table 1). For these blends, the addition of about 0.5 to about 1.0 percent by weight of a representative polycarboxylic acid, polyacrylic acid having molecular weight 10,000 grams/moles, to a crosslinked cellulose fiber (4 percent by weight dimethyloldihydroxy ethylene urea) increases the tensile index by about 100% relative to sheets having the same blend of crosslinked to untreated fibers (i.e., fibers crosslinked with DMDHEU alone in the absence of a polycarboxylic acid).

Example 2 describes the effect of polycarboxylic acid content and cure temperature on fiber sheets incorporating the fibers of the present invention. Generally, increasing the polycarboxylic acid content in the fibers increases the strength of sheets incorporating the fibers, and increasing the cure temperature of the fibers of the present invention decreases the strength of the fiber sheets incorporating the fibers.

The following examples illustrate the practice of the present invention, and are not intended to be limiting thereof.

EXAMPLES

In general, the cellulose fibers of the present invention and products containing these fibers may be prepared by a system and apparatus as described in U.S. Patent No. 5,447,977 to Young, Sr. et al., which is incorporated herein by reference in its entirety.

EXAMPLE 1

The Preparation and Properties of Fiber Sheets Formed From Crosslinked Fibers Having Free Pendant Carboxylic Acid Groups In this example, the preparation and properties of fiber sheets formed from crosslinked fibers having free pendant carboxylic acid groups are described. This example demonstrates that a polycarboxylic acid may be added to other fiber crosslinking systems to enhance the bondability of the fibers into sheets or mats.

In the process, fiber sheets composed of individual cellulose fibers (Weyerhaeuser Co., New Bern, N.C.) were treated with polyacrylic acid having a molecular weight of 10,000 grams/mole (HF-05, Rohm & Haas) and dimethyloldihydroxyethylene urea (DMDHEU) at varying ratios according to the following procedure.

Briefly, a fiber sheet was fed from a roll through a constantly replenished bath of an aqueous solution containing the polyacrylic acid and DMDHEU adjusted to concentrations to achieve the desired level of polyacrylic acid (e.g., about 0.25 to about 1.0% by weight of the total composition) and DMDHEU (e.g., about 2 to about 4% by weight of the total composition) addition to the fiber sheet. The treated fiber sheet was then moved through a roller nip set to remove sufficient solution to provide a fiber sheet having a moisture content of about 50%. After passing through the roll nip, the wet fiber sheet was fiberized by feeding the sheet through a hammermill. The resulting fibers were blown through a flash dryer to a cyclone where the treated cellulose fibers were collected. The curing of the treated fibers was completed by placing the fluff fibers in a laboratory oven and heating at about 330° F. for about 5 minutes.

The crosslinked fibers were then added to untreated southern pine kraft pulp fibers (NB416, Weyerhaeuser Co., Federal Way, Wash.) at a fiber-to-fiber ratio of 2:1 (treated:untreated). The resulting combined fibers were then formed into handsheets using a standard TAPPI handsheet mold. The tensile index of these handsheets was determined using an Instron Tensile Testing Instrument. The results are summarized in Table 1.

TABLE 1

Tensile index of fiber sheets crosslinked with polacrylic acid (PAA) and dimethyloldihydroxyethylene urea (DMDHEU) combinations.

| Percent on Fibers | | Tensile Index |
|---|---|---|
| DMDHEU % | Polyacrylic Acid % | Nm/g |
| 4 | 0 | 0.7 |
| 4 | 0.25 | 1.25 |
| 4 | 0.5 | 1.43 |
| 4 | 1 | 1.44 |
| 3 | 0.5 | 0.83 |
| 2 | 1 | 0.95 |

As shown in Table 1 above, the addition of polyacrylic acid to cellulose fibers crosslinked with a representative urea-based crosslinking agent, DMDHEU, increases the tensile strength of sheets incorporating such crosslinked fibers. At constant DMDHEU crosslinking (e.g., 4 percent by weight), increasing the amount of polyacrylic acid (e.g., from 0 to 1 percent by weight) increases the tensile strength of sheets prepared from the fibers. For example, sheets prepared from crosslinked fibers having from about 0.5 to 1.0 percent by weight polyacrylic acid on the fiber have a tensile strength about twice that of sheets similarly prepared from fibers crosslinked with DMDHEU alone.

The strengths of sheets containing fibers treated with polyacrylic acid and DMDHEU, prepared as described above, in combination with untreated fiber pulps (NB416 and NF405, Weyerhaeuser Co., Federal Way, Wash.) were also determined. Two crosslinking systems of polyacrylic acid and dimethyloldihydroxyethylene urea were used to prepare the treated fibers: (1) PAA:DMDHEU (1:1); and (2) PAA:DMDHEU (1:3). The sheets were prepared by combining the crosslinked and untreated fibers in the ratio of 2:1 (crosslinked:untreated) (designated as PAA:DMDHEU (1:1) and PAA:DMDHEU (1:3) in Table 2 below). A control sheet composed of DMDHEU crosslinked fibers and untreated fibers (2:1) was also prepared for comparison (designated DMDHEU in Table 2 below). For these sheets, the break load, tensile index, and percent strength increase relative to fibers crosslinked with DMDHEU alone are summarized in Table 2.

TABLE 2

Strength of fiber sheets crosslinked with polyacrylic acid (PAA) and dimethyldihydroxy urea (DMDHEU) combinations.

| Composition/ Crosslinking System | Breaking Load (kN/m) | Tensile Index (N/mg) | % Strength Increase |
|---|---|---|---|
| NB 416 | | | |
| DMDHEU | 0.134 | 0.711 | — |
| PAA:DMDHEU (1:1) | 0.177 | 0.964 | 36 |
| PAA:DMDHEU (1:3) | 0.159 | 0.829 | 17 |
| NF 405 | | | |
| DMDHEU | 0.120 | 0.632 | — |
| PAA:DMDHEU (1:1) | 0.155 | 0.806 | 28 |
| PAA:DMDHEU (1:3) | 0.151 | 0.805 | 27 |

As shown in Table 2, the addition of polyacrylic acid to the DMDHEU crosslinking agent results in increased sheet strength relative to sheets prepared from fibers crosslinked with DMDHEU alone. For sheets prepared from crosslinked fibers where the ratio of polyacrylic acid to DMDHEU is 1:1, the sheet strength is increased by about 30% (e.g., 36% increase for NB416, and 28% increase for NB405) relative to sheets prepared from fibers crosslinked with DMDHEU alone. Decreasing the amount of polyacrylic acid in the crosslinked fibers, relative to the DMDHEU crosslinking agent, appears to result in a decrease in the strength of sheets containing these fibers (e.g., 17% increase for PAA:DMDHEU (1:3) compared to 36% increase for PAA:DMDHEU (1:1)).

EXAMPLE 2

The Effect of Polyacrylic Acid Content and Cure Temperature on Fiber Sheets Formed From Crosslinked Fibers Having Free Pendant Carboxylic Acid Groups This example illustrates the effect of polyacrylic acid content and cure temperature on the bulk, absorptive capacity, and tensile strength of fiber sheets formed from crosslinked fibers having free pendant carboxylic acid groups.

An absorptive capacity test is performed on a test pad by recording the initial sample dry weight ($W_1$) in grams. The test pad is then placed on a wire support screen and immersed in synthetic urine, a saline solution containing 135 meq/l sodium, 8.6 meq/l calcium, 7.7 meq/l magnesium, 1.95% urea by weight (based on total weight), plus other ingredients, available from National Scientific under the trade name RICCA in a horizontal position for ten minutes. The pads are removed from the synthetic urine solution and allowed to drain for five minutes. The pads are then placed under a 1.0 psi load for 5 minutes. The wet pad is reweighed ($W_2$) in grams. The total capacity under load is reported as $W_2$-$W_1$. The unit capacity under load is calculated by dividing the total capacity by the dry weight, ($W_2$-$W_1$/$W_1$).

A dry pad tensile integrity test is performed on a 4 inch by 4 inch square test pad by clamping a dry test pad along two opposing sides. About 3 inches of pad length is left visible between the clamps. The sample is pulled vertically in an Instron testing machine and the tensile strength measured is reported in N/m. The tensile strength is converted to tensile index, Nm/g, by dividing the tensile strength by the basis weight g/m$^2$.

In this example, polyacrylic acid (PAA) was combined with dimethyloidihydroxyethylene urea (DMDHEU) at several ratios and applied to a fiber sheet as described above in Example 1. In one set of experiments, the resulting treated fibers were then cured at 330° F., a temperature that fully cures the DMDHEU crosslinking agent, but only partially cures the PAA (i.e., PAA is covalently coupled to the fibers yet the polycarboxylic acid maintains free pendant carboxylic acid groups), to provide DMDHEU crosslinked fibers. Untreated fibers (NB416) were then added to the crosslinked fibers at a fiber-to-fiber ratio of 2:1 (crosslinked:untreated) and formed into handsheets as described above in Example 1. The bulk, absorptive capacity, and tensile index of the handsheets were then determined for the various DMDHEU-:PAA combinations. The results are summarized in Table 3 below.

TABLE 3

The effect of Polyacrylic Acid Content on Fiber Sheet Strength.

| Crosslinking System | Bulk (cm) | Capacity (g/g) | Tensile Index (Nm/g) | % Strength Increase |
|---|---|---|---|---|
| 4% DMDHEU | 14.5 | 14.3 | 1.12 | 0.00 |
| 4% DMDHEU/2% PAA | 14.5 | 14.7 | 1.43 | 27.68 |
| 4% DMDHEU/1% PAA | 15.2 | 15.5 | 1.44 | 28.57 |
| 4% DMDHEU/0.5% PAA | 15.6 | 16.0 | 1.25 | 11.61 |

The results demonstrate that polyacrylic acid can be added to a pulp fiber crosslinking system to enhance the bondability of the fibers into sheets or mats. For the DMDHEU crosslinking system employed above, the greatest increase in sheet strength was found for fibers having a polyacrylic acid content from about 1% to about 2% by weight of the total treated fibers.

In another set of experiments, PAA:DMDHEU treated fibers (i.e., 4% DMDHEU, 1% PAA) were cured at various temperatures (i.e., 340° F., 360° F., 380° F.) and then combined with untreated fibers and formed into sheets as described above. A control sheet composed of DMDHEU crosslinked fiber and untreated fibers was also prepared for comparison. For these sheets, the bulk, absorptive capacity, and tensile index were measured. The results are summarized in Table 4 below.

TABLE 4

The Effect of Cure Temperature on Fiber Sheet Strength.

| Cure Temperature | Bulk (cm) | Capacity (g/g) | % Change in Tensile Index |
|---|---|---|---|
| Control 340° F. | 14.5 | 14.3 | 0.0 |
| 340° F. | 14.3 | 14.2 | 16.1 |
| 360° F. | 14.1 | 14.1 | 11.6 |
| 380° F. | 14.0 | 14.1 | 3.6 |

The results illustrate that increasing the cure temperature for fibers treated with polyacrylic acid provides for more complete reaction between the polyacrylic acid and the cellulose fibers, resulting in the availability of fewer carboxyl groups to enhance bonding in the sheet. The results generally indicate that for these polyacrylic acid-containing sheets a loss in sheet strength occurs with increasing cure temperature.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. Individualized, crosslinked cellulose fibers having free pendant carboxylic acid groups, comprising cellulose fibers crosslinked with a crosslinking agent, and a polycarboxylic acid covalently coupled to the fibers, wherein the crosslinking agent has a cure temperature below the cure temperature of the polycarboxylic acid, and wherein the polycarboxylic acid provides free pendant carboxylic acid groups to the fibers.

2. The fibers of claim 1 wherein the polycarboxylic acid is covalently coupled to the fibers through an ester bond.

3. The fibers of claim 1 wherein the polycarboxylic acid has a molecular weight in the range from about 500 to about 20,000 grams/mole.

4. The fibers of claim 1 wherein the polycarboxylic acid has a molecular weight in the range from about 1,500 to about 5,000 grams/mole.

5. The fibers of claim 1 wherein the polycarboxylic acid is polyacrylic acid.

6. The fibers of claim 1 wherein the polycarboxylic acid is present on the fibers in an amount from about 0.1 to about 10 percent by weight of the fibers.

7. The fibers of claim 1 wherein each polycarboxylic acid provides at least about five free pendant carboxylic acid groups to the fibers.

8. The fibers of claim 1 wherein the crosslinking agent is maleic anhydride.

9. The fibers of claim 1 wherein the crosslinking agent is a urea-based crosslinking agent.

10. The fibers of claim 9 wherein the urea-based crosslinking agent is selected from the group consisting of dimethyloldihydroxyethylene urea, dimethylol urea, dihydroxyethylene urea, dimethylolethylene urea, dimethyldihydroxyethylene urea, and mixtures thereof.

11. The fibers of claim 1 wherein the crosslinking agent is a mixture of maleic anhydride and a urea-based crosslinking agent.

12. The individualized, crosslinked cellulose fibers of claim 1 wherein the cellulose fibers are wood pulp fibers.

13. A fiber sheet comprising individualized cellulose fibers crosslinked with a crosslinking agent, and a polycarboxylic acid covalently coupled to the fibers, wherein the crosslinking agent has a cure temperature below the cure temperature of the polycarboxylic acid, and wherein the polycarboxylic acid provides free pendant carboxylic acid groups to the fibers.

14. The fiber sheet of claim 13 wherein the polycarboxylic acid is polyacrylic acid.

15. The fiber sheet of claim 13 further comprising noncrosslinked cellulose fibers.

16. The fiber sheet of claim 15 wherein the noncrosslinked cellulose fibers are present in an amount from about 10 to about 80 weight percent of the total fibers.

17. An absorbent product comprising individualized cellulose fibers crosslinked with a crosslinking agent, and a polycarboxylic acid covalently coupled to the fibers, wherein the crosslinking agent has a cure temperature below the cure temperature of the polycarboxylic acid, and wherein the polycarboxylic acid provides free pendant carboxylic acid groups to the fibers.

18. The absorbent product of claim 17 wherein the polycarboxylic acid is polyacrylic acid.

19. The absorbent product of claim 17 further comprising noncrosslinked cellulose fibers.

20. A method for producing individualized, crosslinked cellulose fibers having free pendant carboxylic acid groups, comprising:

applying a polycarboxylic acid to cellulose fibers;

applying a crosslinking agent having a cure temperature below the cure temperature of the polycarboxylic acid to the cellulose fibers; and curing the polycarboxylic acid and the crosslinking agent at a temperature sufficient to effect intrafiber crosslink formation, and ester bond formation between the polycarboxylic acid and the crosslinked cellulose fibers to produce crosslinked cellulose fibers having free pendant carboxylic acid groups.

21. The method of claim 20 wherein curing the polycarboxylic acid and crosslinking agent at a temperature sufficient to effect crosslink formation between the crosslinking agent and the fibers, and ester bond formation between the polycarboxylic acid and the fibers comprises heating at about the cure temperature of the crosslinking agent.

22. The method of claim 20 further comprising adding an effective amount of a catalyst to the cellulose fibers prior to curing.

23. A method for producing a high-bulk cellulose fiber sheet having increased tensile strength, comprising:

combining untreated fibers and crosslinked cellulose fibers having free pendant carboxylic acid groups to provide combined fibers wherein the crosslinked cellulose fibers comprise cellulose fibers crosslinked with a crosslinking agent, and a polycarboxylic acid covalently coupled to the crosslinked cellulose fibers, wherein the crosslinking agent has a cure temperature below the cure temperature of the polycarboxylic acid, and wherein the polycarboxylic acid provides free pendant carboxylic acid groups to the crosslinked cellulose fibers; and forming the combined fibers into a sheet to produce a high-bulk cellulose fiber sheet having increased tensile strength compared to fiber sheets prepared from the untreated fibers and crosslinked fibers having no pendant carboxylic acid groups.

24. The method of claim 23 wherein the crosslinked cellulose fibers having free pendant carboxylic acid groups are present in an amount from about 20 to about 90 weight percent of the total fibers.

25. The method of claim 23 wherein the untreated fibers comprise high-bulk fibers.

* * * * *